US007191556B2

(12) United States Patent
Pikielny

(10) Patent No.: US 7,191,556 B2
(45) Date of Patent: Mar. 20, 2007

(54) MAGAZINE SLEEVE

(76) Inventor: Dov Pikielny, 7 Dov Hoz Street, Herzliya 46581 (IL)

( * ) Notice: Subject to any disclaimer, the term of this patent is extended or adjusted under 35 U.S.C. 154(b) by 203 days.

(21) Appl. No.: 11/008,209

(22) Filed: Dec. 10, 2004

(65) Prior Publication Data

US 2006/0130386 A1 Jun. 22, 2006

(51) Int. Cl.
*F41C 23/12* (2006.01)

(52) U.S. Cl. ..... 42/7; 42/50; 42/71.02; 42/72

(58) Field of Classification Search ..... 42/6, 42/7, 50, 71.02, 72
See application file for complete search history.

(56) References Cited

U.S. PATENT DOCUMENTS 1,015,490 A * 1/1912 Harrington ..... 42/7
4,043,066 A * 8/1977 Pachmayr et al. ..... 42/71.02
4,286,401 A * 9/1981 Pachmayr et al. ..... 42/71.02
4,967,502 A * 11/1990 Vernon ..... 42/70.08
5,293,708 A * 3/1994 Strayer et al. ..... 42/75.03
5,526,600 A * 6/1996 Chesnut et al. ..... 42/50
6,557,287 B2 * 5/2003 Wollmann ..... 42/50
2004/0049963 A1 * 3/2004 Christiansen ..... 42/71.02

* cited by examiner

*Primary Examiner*—Stephen M. Johnson
(74) *Attorney, Agent, or Firm*—Dekel Patent Ltd.; David Klein

(57) ABSTRACT

A magazine sleeve attachable to a magazine and including a front strap, a back strap and side panels extending between the front and back straps, wherein the front and back straps and side panels are configured to substantially match an outer contour and/or texture of a grip of a given manufacturer's handgun.

11 Claims, 2 Drawing Sheets

MAGAZINE SLEEVE

FIELD OF THE INVENTION

The present invention relates generally to weapons and magazine accessories, and particularly to a magazine sleeve that fits on a magazine to serve as a grip extender, and which matches characterizing features, e.g., look, of the grip of the weapon.

BACKGROUND OF THE INVENTION

As is well known in the art, handguns, e.g., pistols, come in a variety of manufactured sizes, e.g., some referred to as full-size, compact and sub-compact. A magazine containing rounds of ammunition is inserted in a magazine well formed in the grip of the pistol. Magazines are manufactured in different sizes in accordance with the size of the handgun as well as in accordance to the number of rounds that the magazine holds, such that the floor plate of the magazine is generally flush with the bottom of the grip. Accordingly, the standard magazine manufactured for the full-size pistol is longer and holds more rounds than the magazine for the compact model, and of course even longer and with even more rounds than the one for the sub-compact model.

Although a full-size magazine may be inserted in the grip of a sub-compact pistol, it is neither aesthetically pleasing nor is it comfortable in the shooter's hand, because a gap exists between the bottom of the grip down to the floor plate of the magazine.

Grip extenders have been developed to fill in this gap in an effort to solve the aesthetics and comfort problems. For example, the Pearce Grip Company (Fort Worth, Tex.) makes different lines of grip extenders for use with different manufacturers of handguns, such as Springfield Armory XD, Beretta or Glock. In order to install these grip extenders, the floor plate of the magazine must be removed (requiring tools). The magazine is then retrofitted with the grip extender, which comes with its own floor plate, or the old floor plate is attached to the grip extender (again requiring tools). Some of the grip extenders maintain some, but not all, of the contour and feel of the manufactured grip, such as the Pearce grip extenders for some of the Glock models, which have a front strap that resembles the front strap of the Glock grip. However, these grip extenders do not maintain the rear contour of the grip and do not have the features of the back strap of the grip.

SUMMARY OF THE INVENTION

The present invention seeks to provide a magazine sleeve that fits on a magazine to serve as a grip extender. Unlike the prior art, the magazine sleeve of the present invention fully matches the characterizing features of the grip of the weapon, as is described more in detail hereinbelow. In accordance with a non-limiting embodiment of the present invention, the magazine sleeve may be slipped on to the existing magazine (loose fit or tight fit or any other fit) with no need for any removal of parts or any retrofitting.

There is provided in accordance with an embodiment of the present invention a weapon accessory including a magazine sleeve attachable to a magazine and including a front strap, a back strap and side panels extending between the front and back straps, wherein the front and back straps and side panels are configured to substantially match an outer contour and/or texture of a grip of a given manufacturer's handgun. For example, the front and/or back strap may not be straight. The back strap may be formed with a cutout having a shape to receive therein a lip that protrudes from a rear lower portion of the grip of the given manufacturer's handgun.

A hollow portion may be defined and encompassed by the front and back straps and side panels, the hollow portion being configured for the magazine to fit therethrough.

In accordance with an embodiment of the present invention a gun lock may be disposed in a portion of the magazine sleeve.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
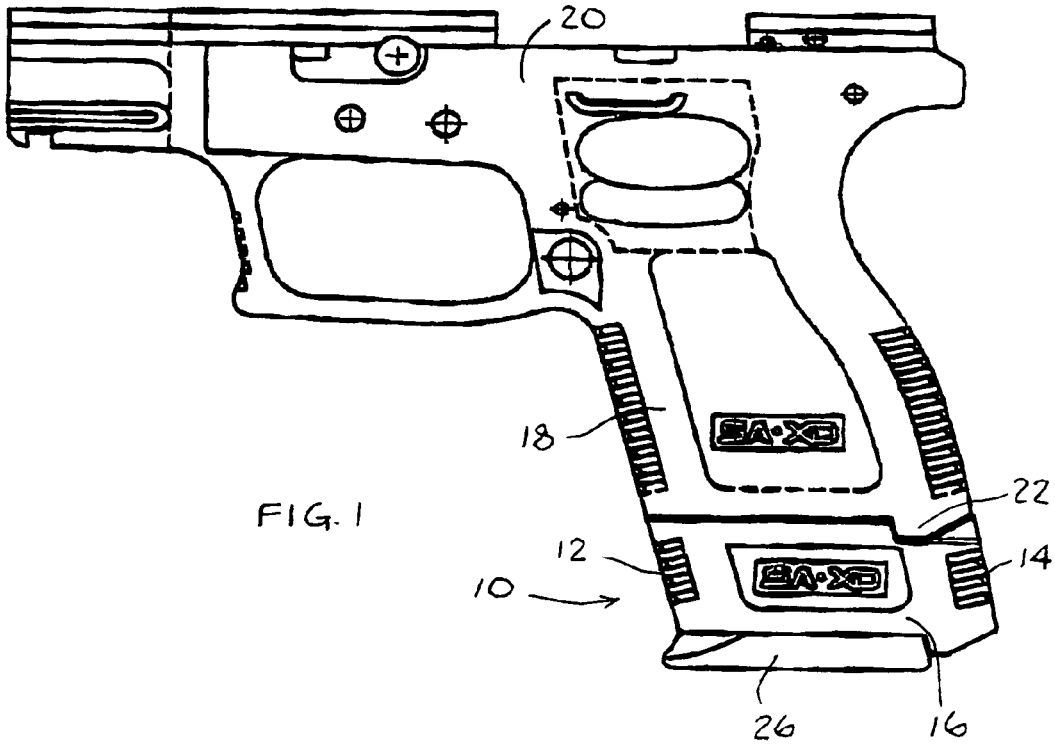
FIG. 1 is a simplified pictorial illustration of a magazine sleeve fitted over a magazine and inserted in a grip of a manufacturer's compact handgun, giving the appearance and external contour of the same manufacturer's full-size handgun, in accordance with an embodiment of the present invention.
Figure 2:
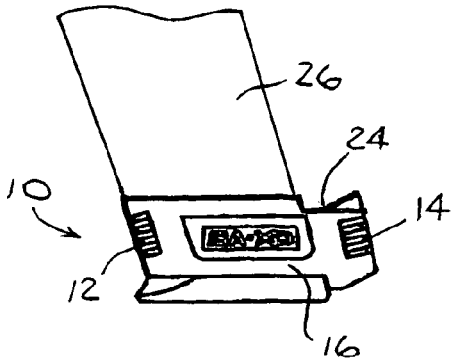
FIG. 2 is a simplified pictorial illustration of the magazine sleeve of FIG. 1 fitted over a magazine.

Reference is now made to FIGS. 1 and 2, which illustrate a weapon accessory, which is a magazine sleeve 10, constructed and operative in accordance with an embodiment of the present invention.

The magazine sleeve 10 may be constructed of any suitable material, such as but not limited to, polymer, composite material, metal, wood, elastomer (e.g., rubber) and others. The magazine sleeve 10 may include a front strap 12, a back strap 14 and side panels 16 extending between the front and back straps 12 and 14. The front and back straps 12 and 14 and the side panels 16 are configured to substantially match an outer contour of a grip 18 of a given manufacturer's handgun 20.

For example, in the non-limiting illustrated embodiment, the handgun is the XD model, commercially available from Springfield Armory. The XD comes in a model with a full-size grip and another model with a compact grip (shorter in length than the full-size grip) and a sub-compact model. The model illustrated in FIG. 1 is the sub-compact XD. The front and back straps of the XD's grip 18 have a series of grooves formed therein. As is well known in the art, the grooves provide a certain texture to the grip for enhanced comfort and gripping ability. Other textures are also known in the art, examples of which are described hereinbelow. The side panels of the grip 18 have the logo "SA-XD" molded or otherwise formed therein.

As mentioned before, the front and back straps 12 and 14 and the side panels 16 are configured to substantially match an outer contour of the grip 18. Accordingly, in the illustrated embodiment, the front strap 12 is generally straight, whereas the back strap 14 is not straight, rather curved to match and continue the curvature of the back strap of the XD. In addition, the front and back straps 12 and 14 have a texture to match the grip 18 of the XD, wherein the front and back straps 12 and 14 have a series of grooves formed therein to match those of the XD's grip 18. One or both of the side panels 16 of the magazine sleeve 10 may have the logo "SA-XD" molded or otherwise formed therein, to match the design of the XD grip 18.

The XD model handgun has a lip 22 that protrudes from a rear lower portion of the grip 18. Accordingly, the back strap 14 of the magazine sleeve 10 may be formed with a cutout 24 having a complementary shape to receive therein lip 22.

The Springfield Armory XD is an example of a given manufacturer's handgun, which is one of a series of manufactured handguns that includes two or more sizes of grips (e.g., full-size, compact and sub-compact). As is seen in FIG. 1, when the magazine sleeve 10 is placed against the grip 18 of a smaller of the grip sizes (e.g., sub-compact), the magazine sleeve 10 extends that grip a feel and appearance of a larger grip (e.g., full-size). In accordance with an embodiment of the present invention, a combination of two or more sleeves may be placed in a row to extend very small grip models to larger sizes. For example, two or more sleeves may be combined to extend a sub-compact pistol or even an ultra-sub-compact pistol to a full-sized pistol.

Figure 4:
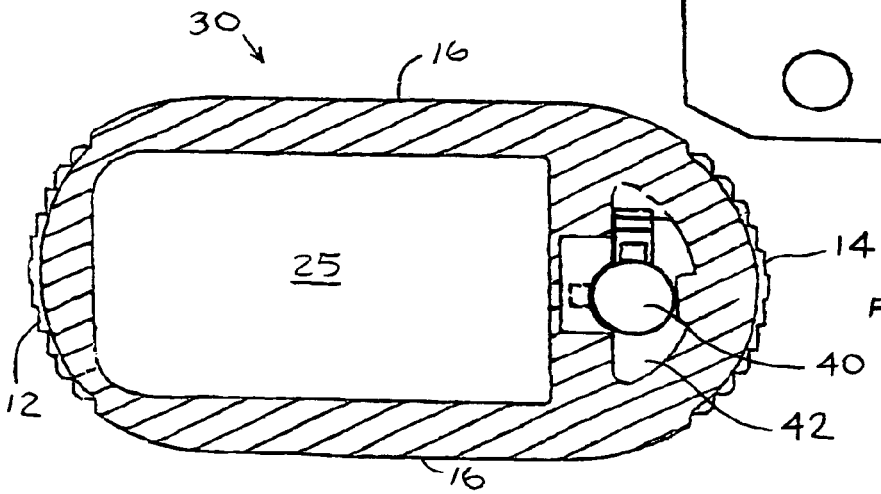
FIG. 4 is a simplified sectional illustration of a cross section through the magazine sleeve, taken along lines IV—IV in FIG. 3.

Referring to FIG. 4, a hollow portion 25 may be defined and encompassed by front and back straps 12 and 14 and side panels 16 designed to completely fit the external contour of the handgun's grip. The hollow portion 25 is configured for a magazine 26 to fit therethrough. The magazine sleeve 10 may thus fit over the magazine 26 by a firm fit, without any need for a screw or any other mechanical element, and without any need for replacing the floor plate.

As mentioned previously, the front and back straps 12 and 14 may have a texture to match the grip 18 of the XD, wherein the front and back straps 12 and 14 have a series of grooves formed therein to match those of the XD's grip 18. Many other textures are also known in the art, and the present invention also contemplates using any texture or combination of textures. For example, without limitation, the texture may include checkering (e.g., 20–50 lines per inch), stippling, conical pyramids (also known as "Conamyds", created by gunsmith Ned Christiansen of Three Rivers, Mich., which comprise complex intersections and lines milled into the front strap), or snakeskin pattern (made by Ed Brown of Perry, Mo., comprising a complex pattern of machined ridges on the front strap that resemble a snake's scale pattern).

Figure 3:
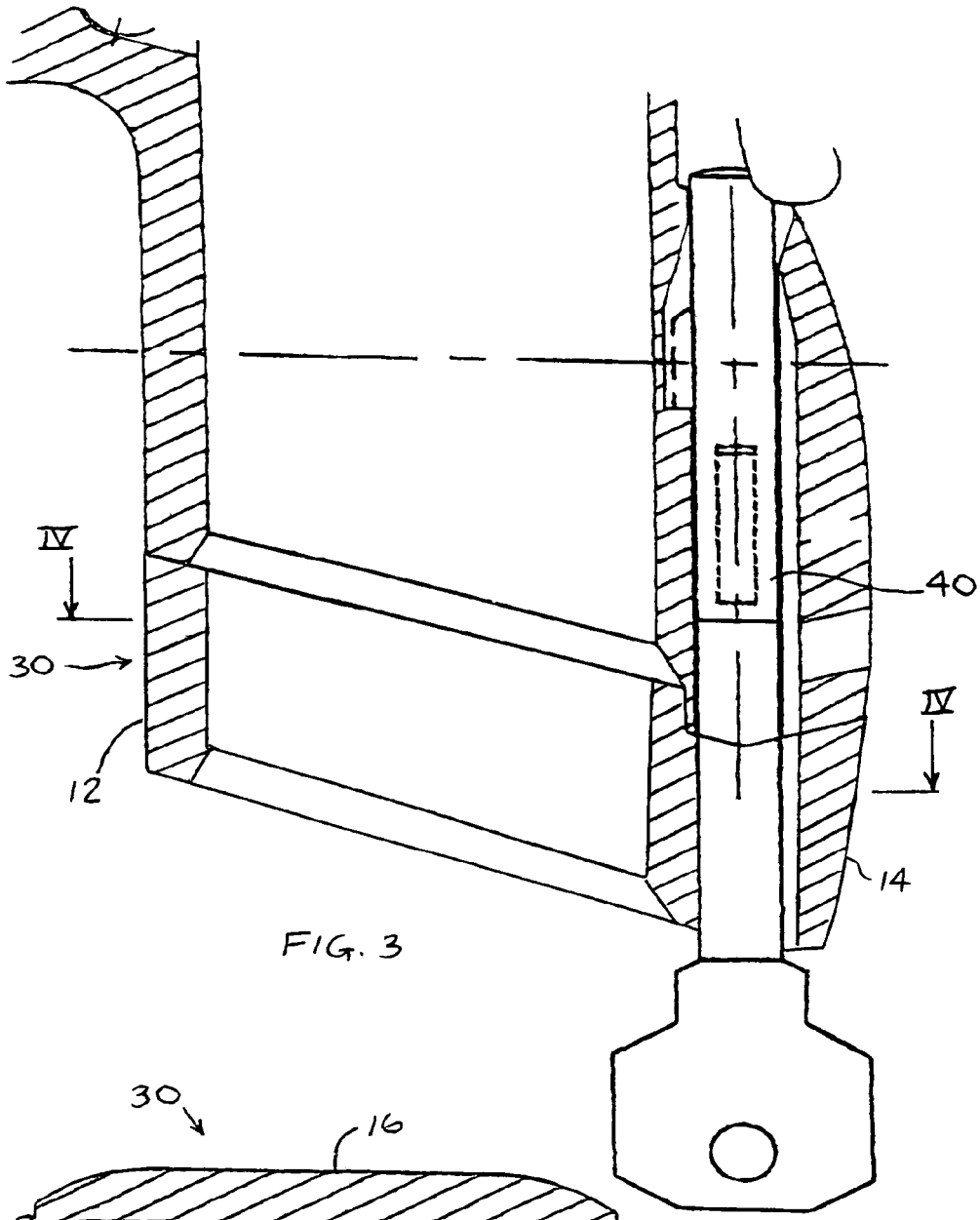
FIG. 3 is a simplified sectional illustration of a magazine sleeve with a gun lock disposed therein, in accordance with an embodiment of the present invention.

Reference is now made to FIG. 3, which illustrates a magazine sleeve 30 with a gun lock 40 disposed therein, in accordance with an embodiment of the present invention. Magazine sleeve 30 may be identical to magazine sleeve 10, with identical elements being designated by identical reference numerals, although the illustration shows a modification wherein magazine sleeve 30 has an angled bottom surface to match the angled bottom surface of the handgun grip, whereas magazine sleeve 10 has a generally straight bottom surface.

The gun lock 40 may include any type of gun lock, such as but not limited to, a key-operated gun lock that locks one of the safeties of the weapon, as is known in the art. The gun lock 40 may be disposed in a portion of magazine sleeve 30. For example, the gun lock 40 may slip through an aperture 42 formed in a rear portion of magazine sleeve 30 near the back strap 14. Although gun locks are known in the art that pass through a portion of the grip of the weapon, a gun lock that passes through a magazine sleeve has not been known heretofore.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A weapon accessory comprising:

a magazine sleeve attachable to a magazine and comprising a front strap, a back strap and side panels extending between said front and back straps, wherein said front and back straps and side panels are configured to substantially match an outer contour of a grip of a given manufacturer's handgun, and wherein a said side panel of said magazine sleeve comprises a logo formed therein which substantially matches a logo of the given manufacturer's handgun formed on the grip of the given manufacturer's handgun.

2. The weapon accessory according to claim 1, wherein said front and back straps and side panels are configured to substantially match a texture of the grip of the given manufacturer's handgun.

3. The weapon accessory according to claim 1, wherein the given manufacturer's handgun is one of a series of manufactured handguns that includes at least two sizes of grips, and wherein said magazine sleeve, when placed against the grip of a smaller of the at least two sizes of grips, extends that grip and gives that grip an appearance of a larger of the at least two sizes of grips.

4. The weapon accessory according to claim 1, wherein at least one of said front and back straps is not straight.

5. The weapon accessory according to claim 1, wherein a hollow portion is defined and encompassed by said front and back straps and side panels, said hollow portion being configured for the magazine to fit therethrough.

6. The weapon accessory according to claim 1, wherein the texture of at least one of said front and back straps and said side panels comprises grooves.

7. The weapon accessory according to claim 1, wherein the texture of at least one of said front and back straps and said side panels comprises checkering.

8. The weapon accessory according to claim 1, wherein the texture of at least one of said front and back straps and said side panels comprises stippling.

9. The weapon accessory according to claim 1, wherein the texture of at least one of said front and back straps and said side panels comprises conical pyramids.

10. The weapon accessory according to claim 1, further comprising a gun lock disposed in a portion of said magazine sleeve.

11. A weapon accessory comprising:

a magazine sleeve attachable to a magazine and comprising a front strap, a back strap and side panels extending between said front and back straps, wherein said front and back straps and side panels are configured to substantially match an outer contour of a grip of a given manufacturer's handgun, wherein said magazine sleeve has an upper surface configured to match and mate with a lower surface of the grip of the given manufacturer's handgun, said upper surface comprising a straight portion that extends from the front strap rearward until but not including the back strap, wherein at the back strap said upper surface is formed with a cutout comprising a first cutout portion that extends angularly downwards from said straight portion, a second cutout portion extending from said first cutout portion generally parallel to said straight portion and a third cutout portion that extends angularly upwards from said second cutout portion to a rear surface of said back strap.

* * * * *